United States Patent [19]

Rysti

[11] 4,164,248

[45] Aug. 14, 1979

[54] METHOD AND APPARATUS FOR CUTTING OFF DEFECTIVE PORTIONS OF LENGTHS OF TIMBER

[76] Inventor: Alpo Rysti, Frisansintie 22, 02240 Espoo 24, Finland

[21] Appl. No.: 866,391

[22] Filed: Dec. 30, 1977

[51] Int. Cl.[2] ..... B27B 1/00

[52] U.S. Cl. ..... 144/312; 83/361; 83/367; 83/521; 144/2 R; 144/323; 350/285

[58] Field of Search ..... 83/520, 522, 361, 364, 83/367, 425.4, 521; 350/6.1, 6.7, 285; 144/2 R, 312, 326 R, 309 R, 323

[56] References Cited

U.S. PATENT DOCUMENTS

| | | | |
|---|---|---|---|
| 1,476,238 | 12/1923 | Bump | 83/425.4 |
| 2,918,951 | 12/1959 | Haumann | 83/522 |
| 3,565,140 | 2/1971 | Jacobsen | 144/312 |
| 3,736,968 | 6/1973 | Mason | 144/312 |
| 3,890,509 | 6/1975 | Maxey | 144/312 X |
| 3,983,403 | 9/1976 | Dahlstrom et al. | 144/312 X |
| 4,023,605 | 5/1977 | Hellstrom et al. | 144/312 |
| 4,093,007 | 6/1978 | Hellstrom | 144/312 X |

*Primary Examiner*—Donald R. Schran
*Assistant Examiner*—W. D. Bray
*Attorney, Agent, or Firm*—Steinberg and Blake

[57] ABSTRACT

A method and apparatus for cutting portions having defects therein from lengths of timber includes determining an aligning distance for a given one of the lengths of timber as the timber length moves along a conveyor, the aligning distance being defined by the distance between a cutting line located next to the defect and one of a series of parallel lines which extend in the conveying direction, indexing the timber length in a direction transverse to the conveying direction to align the cutting line with one of the parallel lines and then incrementally moving the timber length in a direction transverse to the conveying direction a member of incremental distances determined by the particular one of the series of parallel lines with which the cutting line is aligned and cutting the timber length along the cutting line.

10 Claims, 4 Drawing Figures

C1
C2
D1
D2
B
B
F
G
(II)
(III)
A1
A2
K1
K2
P1
P2
L1
(I)
L2
a1
a2
t1
t2
Δt
Δt

METHOD AND APPARATUS FOR CUTTING OFF DEFECTIVE PORTIONS OF LENGTHS OF TIMBER

BACKGROUND OF THE INVENTION

The present invention relates to methods and apparatus for treating lengths of timber in such a way that a length of timber which has a defect therein can be cut into a pair of pieces only one of which will have the defect.

The present invention relates in particular to methods and apparatus for determining a cutting line for such lengths of timber and for bringing this cutting line into alignment with a cutting means which will serve to cut the timber properly along the predetermined cutting line while the lengths of timber are continuously conveyed. Thus the present invention relates to a method and apparatus for longitudinally shifting lengths of timber transversely of their path of travel in order to properly determine where the lengths of timber will be cut so as to separate them into pieces for removing defects from the lengths of timber.

In order to save raw material, accurate sorting of lengths of timber has in recent times become the primary emphasis in the sawmill industry as well as other mechanical wood-refining industries. Subsequent to sawing and planing of timber, attempts are made to achieve the best possible quality of the timber by axially cutting away therefrom portions which have defects therein. Thus, by removing from a length of timber a portion thereof which has a defect therein, the remaining length of timber will have a higher quality and thus can command a higher price.

With the present-day development of timber-handling equipment, it is no longer possible or feasible to use workers to pull lengths of timber to cutting positions. The reason for this is that the work itself is extremely heavy and the sorting installations operate at a speed which is too great to enable such operations to be manually performed.

A common method utilized in cutting timber involves cutting the same into predetermined lengths so as to produce so-called module timber lengths. In this case, the method and apparatus of the present invention are utilized for cutting the timber at the region of one end therof, while the remainder of the timber is cut in the normal way to achieve the module-lengths thereof. At the present time, the cutting of timber into such module lengths is achieving greater importance. With the present invention it is possible to operate either on one or both ends of such lengths of timber in connection with the cutting thereof into suitable lengths.

With respect to the state of the prior art, reference may be made to Finnish Pat. Nos. 43,968 and 41,817, which illustrate features which can be utilized or applicable in connection with the method and apparatus of the present invention. Also, reference may be made to Finnish Pat. Nos. 44,046 and 49,586 both of which illustrate attempts to even up timber into specific dimensions.

According to Finnish Pat. No. 751,931, there is a disclosure enabling achievement of the same results which are achieved by way of the present invention. However, according to this patent it is necessary to utilize expensive and complex equipment and cutting operations must be carried out at two different places on a given length of timber, thus undesirably increasing the costs and the number of cut-off timber portions.

SUMMARY OF THE INVENTION

It is accordingly a primary object of the present invention to avoid the drawbacks of known methods and apparatus and instead to provide a relatively simple method and apparatus according to which it becomes possible to operate on lengths of timber in such a way as to remove therefrom portions which have defects therein.

A further object of the present invention is to provide a method and apparatus of the above type according to which the removed portions can be made of a length sufficient to enable them to be used as raw material for certain purposes such as in finger scarfing machines.

Also, it is an object of the present invention to eliminate the aforementioned drawbacks by providing a mechanicaly simple method and apparatus in which only one cutting location is required for a given length of timber.

Also it is an object of the present invention to provide a method and apparatus according to which the operator cannot make a mistake after he has selected the correct cutting line for a given length of timber.

According to the method and apparatus of the present invention the cutting line for a given length of timber is determined by situating a line of light on the length of timber next to a defect therein, this line of light being situated on the particular length of timber while it is conveyed past a given location where there is an operator who actuates a structure to properly situate the line of light which will determine the cutting line. The situation of the cutting line next to a defect in a length of timber is utilized to provide electrical signals which are transmitted first to a pusher which moves the length of timber so as to situate the cutting line in alignment with one of a series of second lines which extend in the path of travel parallel to each other and which are situated at equal predetermined incremental distances from each other. A second signal is transmitted to an incremental moving means situated subsequent to the pusher along the path of travel of the conveyed length of timber, this incremental moving means acting upon the aligned length of timber to move the same through a number of incremental distances, equal to the above incremental distances sufficient to situate the cutting line in alignment with a cutting means which is situated along the path of movement of the conveyed length of timber subsequent to the incremental moving means. Thus the incremental moving means will move a given length of timber through a given number of incremental distances as required in order to situate the cutting line in alignment with the cutting means so that when reaching the latter the timber will be cut at the cutting line in an accurate manner separating the cut length of timber into two pieces only one of which will have the defect therein.

A primary feature of the invention resides in providing an operator with a manually turnable crank means connected to an adjustable reflecting means which has a mirror capable of reflecting a line of light derived from a predetermined light source onto the moving timber while the latter is conveyed. This crank means is operatively connected with a signal transmitting means including a pair of potentiometers which are automatically adjusted by turning of the crank means so as to provide a pair of signals of magnitudes which will properly actuate the above pusher and incremental moving means. The transmission of these signals can start by providing for the operator a button which he pushes when the timber reaches a location in front of the operator.

A particularly advanced application of the method and apparatus of the invention resides in an arrangement where defects in timber are detected with an optical surface-sensing equipment which is being developed which is already partially in use, the moving impulse being transmitted automatically to a computer system. In the simplest application of the pesent invention, the first movement, which is only a fraction of one of the incremental distances referred to above, can be carried out manually in accordance with certain scale lines which are painted or otherwise provided on a table along which the lengths of timber are conveyed.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
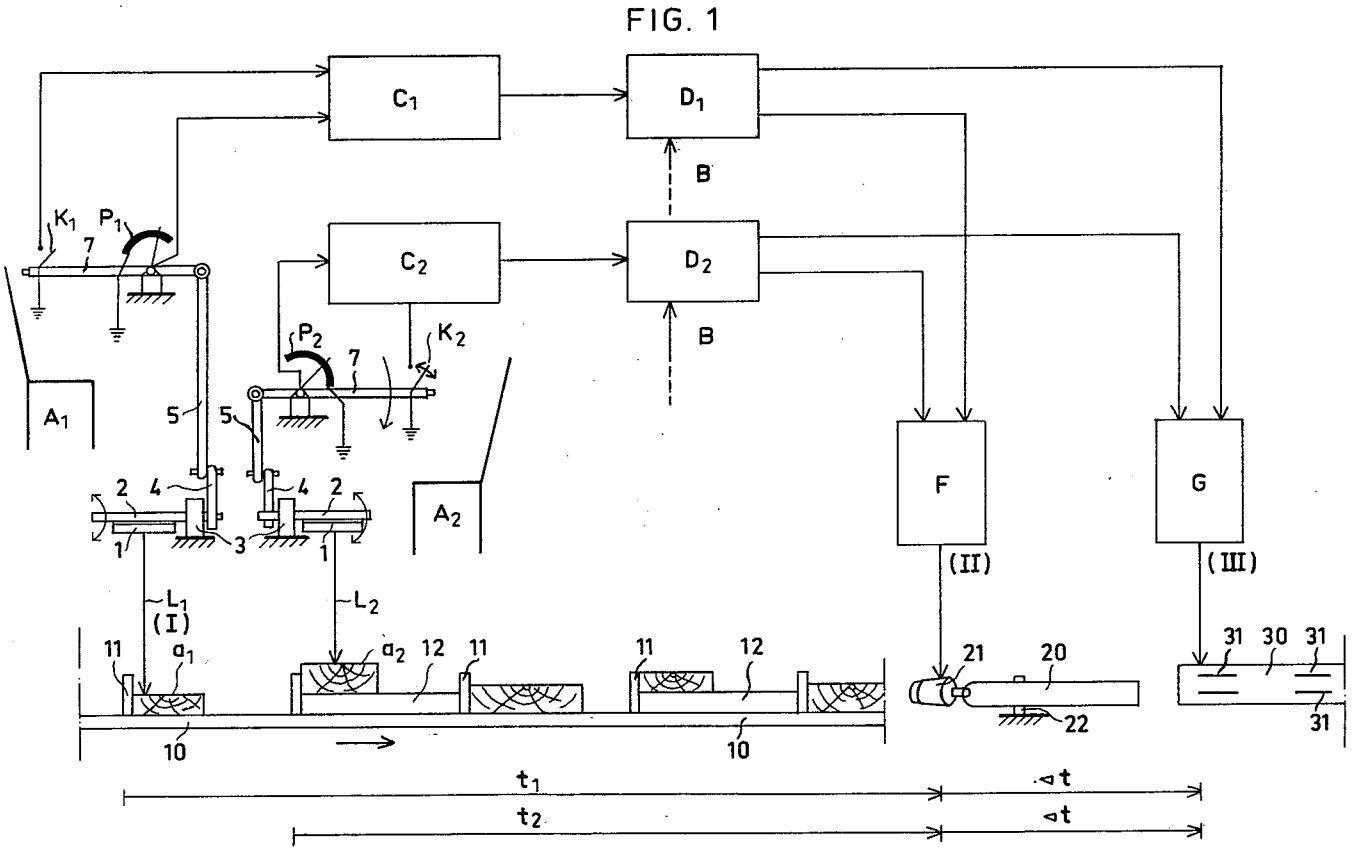
FIG. 1 is a schematic side elevation and block diagram of a method and apparatus according to the invention illustrating the principle of operation of the invention.

Referring to FIG. 1, there are schematically illustrated therein the locations of a pair of cutter operators $A_1$ and $A_2$. However, in FIGS. 2 and 3, for the sake of clarity, only one operator $A_1$ is illustrated. Of course, there may be more than two cutter operators. In the general case there will be n operators, in which case each operator will operate on every nth timber piece which arrives on a conveyer means at a given location in front of each operator. Each operator has his own equipment for adjustably situating a line of light at a location which will determine a cutting line as well as for operating a signal-transmitting means provided for each operator. On the other hand, subsequent to the operators there are only two means 20 and 30, the means 20 being a pusher means while the means 30 is an incremental moving means as described in greater detail below. These means cooperate with a schematically illustrated conveyer means 10 as well as with a schematically illustrated cutting means 40.

Figure 2:
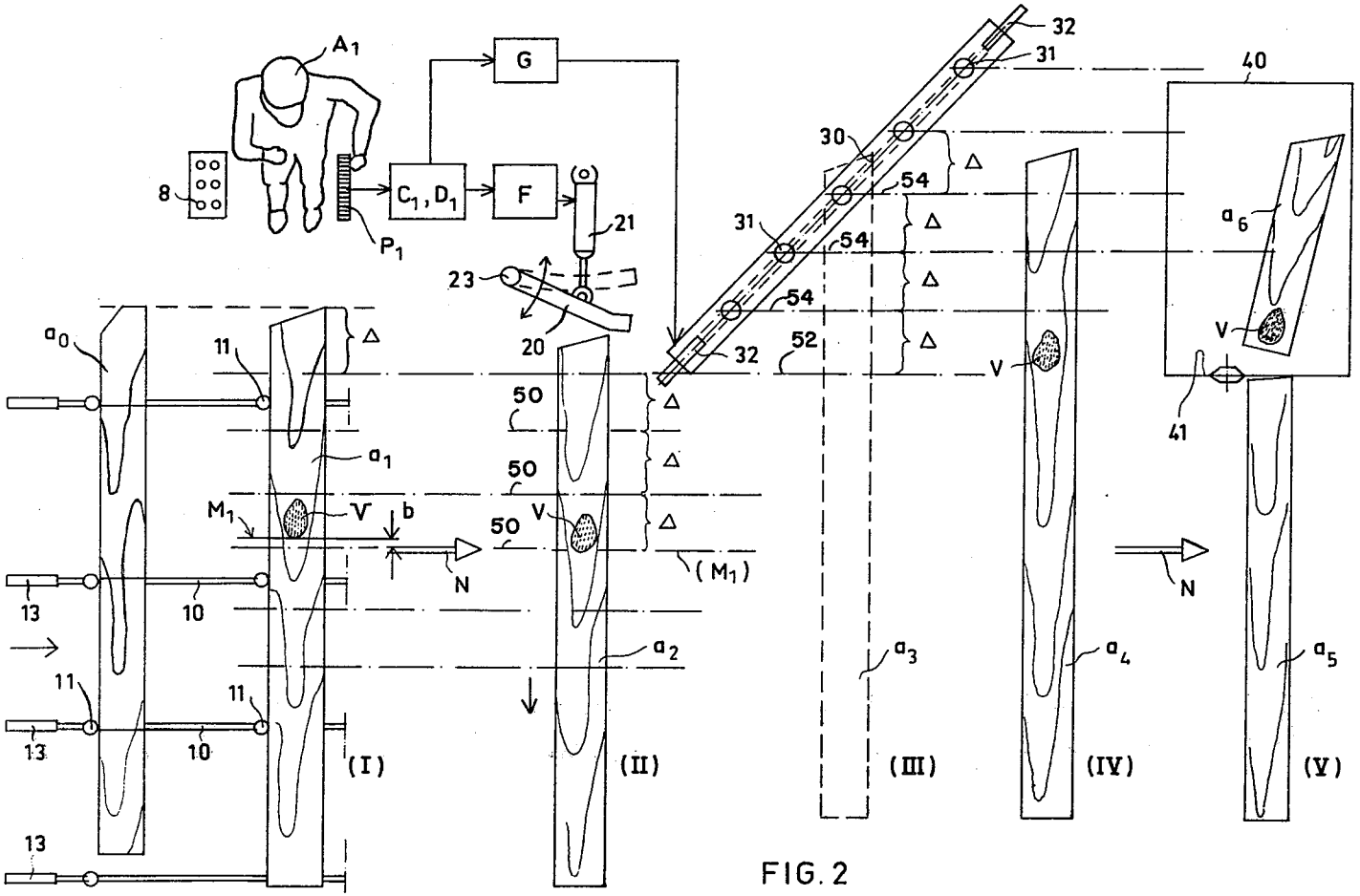
FIG. 2 is a schematic plan view of an apparatus and method of the invention, with FIG. 2 illustrating successive phases in the operation of the invention.

The schematically illustrated conveyer means 10 may take the form of a plurality of parallel endless chains which are operated by way of suitable sprocket wheels 13 schematically illustrated at the left of FIG. 2. The conveyor means 10 operates at a uniform speed to convey lengths of timber in the direction of the arrow N shown in FIG. 2, along a predetermined path with the lengths of timber arranged in succession along this path extending transversely thereof. The several lengths of timber are successively delivered to the conveyer means 10 in such a way that upstanding members 11 on the chains of the conveyer will engage the trailing side surfaces of the timber lengths to convey the latter in the manner illustrated.

As is shown in FIG. 2, a given operator $A_1$ is situated at a given location along the predetermined path of movement of the lengths of timber, and at a second location along this path subsequent to the location of the operator there is the schematically illustrated pusher means 20. This pusher means 20 is adjustable and is situated in the path of movement of the ends of the lengths of timber which are nearest to the operator.

Situated at a third location along the path of movement, subsequent to the second location, is the incremental moving means 30 which is schematically illustrated and which is in the form of a conveyor inclined with respect to the conveyer means 10, the conveyer which forms the incremental moving means 30 being well known. The inclined incremental conveyer means 30 has a component of movement parallel to the direction of movement provided by the conveyer means 10 which equals the speed with which the lengths of timber are moved by the conveyer means 10. The incremental conveyer means 30 has in a known way a plurality of timber-gripping units 31 capable of seizing the end of each length of timber and pulling the same transversely with respect to its direction of travel through a given number of incremental distances Δ, the units 30 cooperating with the length of timber to release the latter after it has been displaced by a predetermined number of these incremental distances sufficient to situate a cutting line on the length of timber in alignment with the cutting edge 41 of a cutting means 40 situated at a fourth location along the path of movement subsequent to the third location and capable of cutting across the length of timber at the previously selected cutting line.

As is shown schematically in FIG. 1, the pair of operators $A_1$ and $A_2$ are capable of manually operating a pair of adjustable indicating means which respectively include a pair of adjustable reflecting means 1. Each of the latter means includes the illustrated mirror 1 which is carried by a frame part 2. The frame part 2 in turn is supported for turning movement by a bearing structure 3, and the frame part 2 has operatively connected thereto an arm 4 which in turn is pivotally connected with a second arm 5. The arm 5 of each of these units is in turn pivotally connected with a lever or crank means 7 which can be manipulated by the operator. The pair of crank means 7 respectively provided for the pair of operators in the illustrated example are each capable of operating a signal-transmitting means which includes a pair of potentiometers $P_1$ and $P_2$, the signals being transmitted when the operators $A_1$, $A_2$ respectively actuate the schematically illustrated switches $K_1$, $K_2$.

Figure 3:
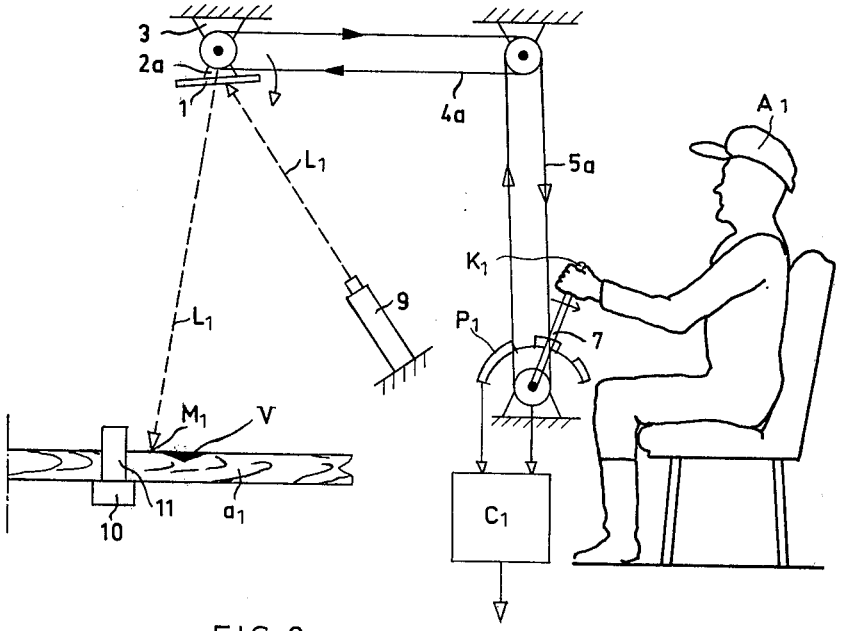
FIG. 3 is a schematic side elevation illustrating how an operator adjusts a line of light.

A variation of the construction of each indicating means is apparent from FIG. 3. Thus, as is shown in FIG. 3, there is available to each operator a crank means 7 which can be turned in order to actuate the illustrated pulley-and-belt system 5*a*, which in turn operates the pulley-and-belt system 4*a*. The output pulley of the latter system turns the frame 2*a*, corresponding to the frame part 2 of FIG. 1, about the pivot determined by the bearing structure 3, this pivot being perpendicular to the plane of FIG. 3. Thus the mirror 1 will be tilted about a horizontal axis as indicated by the arrow shown to the right of the mirror 1 in FIG. 3.

As is shown schematically in FIG. 3 a light-source means 9 is provided for each reflecting means 1. This light-source means 9 includes a lamp which directs light through an elongated slit which provides a line of light travelling along the path $L_1$, this path in part extending from the source 9 to the mirror 1 and in part from the latter to the timber, a timber length $a_1$ being indicated in FIG. 3. As is indicated above, these units are duplicated for the several operators so that in FIG. 1 there is shown a light path $L_1$ for the operator $A_1$ and a light path $L_2$ for the operator $A_2$.

The line of light which is thus delivered to each length of timber arriving to a location in front of each operator extends in the direction of travel of the several lengths of timber across the same. It is thus possible for each operator to shift the line of light longitudinally along each length of timber while it is conveyed past the operator so that it becomes possible for the operator $A_1$ in FIG. 2 to situate the line of light at the location $M_1$ indicated in FIG. 2. It will be seen that this location is directly next to a defect V in the length of timber $a_1$ which has just arrived at the given location in front of the operator $A_1$.

Of course, instead of using belts and pulleys for the systems *4a*, *5a*, it is also possible to use chains and sprockets.

While it is possible to provide the above systems with structure capable of tilting the mirrors about an axis perpendicular to that provided by the bearing 3, so that the light line can move together with the timber to automatically follow a given length of timber, the light lines can easily be made of a length sufficient to be several times the width of a length of timber so that the latter will remain with a light line clearly visible thereon during a considerable portion of the path of travel at the region of the given location which is in front of the particular operator. Thus, each operator has sufficient time to situate the light line at a location for suitably indicating the cutting line, namely directly next to the defect V which is perceived by the operator. As each operator operates the crank means 7 to properly situate the light line, the angular position of the crank means 7 changes, and when it has reached the angular position which provides the desired location for the light line, this angular position can be utilized for transmitting proper signals to the pusher means 20 and the incremental moving means 30.

Referring to FIGS. 2 and 3 it will thus be seen that there is illustrated therein a length of timber $a_1$ which has a defect V, and the operator $A_1$ has located the line of light $M_1$ so that it will be situated next to the defect V, thus determining the cutting line. As soon as this cutting line is determined and the length of timber, $a_1$ in the above example, is situated at the given location in front of the operator $A_1$ in FIG. 2, the operator closes the switch $K_1$ which is available to him. The turning of the crank means 7 has simultaneously displaced sliders of a potentiometer assembly $P_1$ at suitable locations thereon for achieving signals of a predetermined magnitude determined by the angular position of the crank means 7, these signals being provided upon closing of the switch $K_1$. Thus, the voltage level or pulse sequence determined by the position of the potentiometer is in fact determined by the position of the crank means 7 and is registered upon closing the switch in a unit $C_1$ which is operatively connected with the potentiometer $P_1$ for the operator $A_1$, in the manner shown in FIG. 1. Of course the same operations may take place with respect to the unit $C_2$ by the operator $A_2$. The voltage level or pulse sequence, in the form of an analog or digital signal, forms a control signal which will determine the extent to which the pair of means 20 and 30 are actuated so as to move the particular length of timber longitudinally in order to provide at the cutting means 40 cutting along the cutting line determined by the location of the light line $M_1$.

Inasmuch as the pair of means 20 and 30 should not operate simultaneously at the moment when the operator closes the particular switch $K_1$ or $K_2$, the system is provided with delay lines $D_1$ and $D_2$ operating in synchronism with the travelling speed of the conveyer means 10, as indicated by the signal B shown in FIG. 1 delivered to each of the units $D_1$ and $D_2$. Thus the pusher means 20 will be adjusted by the time that the particular length of timber which is to be moved thereby reaches the location thereof, and the incremental moving means 30 will be operated by the time that the particular piece of timber which is to be moved thereby reaches the same. FIG. 1 schematically illustrates by way of the block F and G transformers and actuating equipment which are respectively operatively connected with the pusher means 20 and the incremental moving means 30 so as to operate the same in accordance with the magnitude of the signals determined by the position of the crank means 7.

As is indicated in FIG. 1, where there are two operators, every other lengths of timber is supported on a suitable spacer 12 carried by the conveyor means 10 so that the successive lengths of timber will alternately be located at different elevations with one operator operating on every other length of timber situated at one elevation while the other operator operates on the remaining lengths of timber which are situated at a different elevation. In this way each operator will know which lengths of timber he is required to control.

FIG. 1 schematically illustrates a delay interval $t_1$, this being the particular delay time required for the length of timber $a_1$ to reach the pusher means 20. The delay interval $t_2$ is required for the length of timber $a_2$ shown in FIG. 1 to reach the pusher means 20. These are the delay intervals by which the units $D_1$ and $D_2$ respectively delay actuation of the pusher means 20. These particular delay intervals are increased by the intervals $\Delta t$ shown in FIG. 1, for actuating the incremental moving means 30. Thus these different delay intervals will be provided by the units $D_1$ and $D_2$ to provide for operation of the pair of means 20 and 30 at the proper times. Thus, even though there may be one or more given locations where there are operators respectively situated to provide cutting lines indicated above, nevertheless all of the lengths of timber will be operated upon only by one pusher means 20 and one incremental moving means 30.

Figure 4:
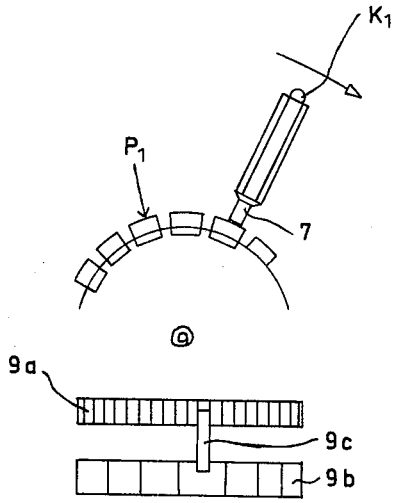
FIG. 4 is a schematic representation of a signal-transmitting means of the invention.

As is shown in FIG. 4, each of the potentiometer units $P_1$ and $P_2$ includes a pair of arcuate variable resistor assemblies *9a* and *9b* each engaged by a common slider *9c* which is connected with the crank 7 to be moved thereby along the pair of arcuate variable resistors *9a*, *9b* in the manner apparent from FIG. 4. The potentiometer portion *9a* provides the signal for the pusher means 20 while the potentiometer portion *9b* provides the signal for the incremental moving means 30.

As is schematically shown in FIG. 2, the unit F will control the flow of hydraulic fluid to a hydraulic piston-and-cylinder assembly 21 which is operatively connected with the pusher 20 so as to turn the latter about the axis determined by the pivot 23.

The apparatus includes a number of real or imaginary parallel lines 50 schematically indicated in FIG. 2 and extending in the general direction of travel of the lengths of timber. These lines 50 are situated at equal incremental distances Δ from each other as illustrated. These lines 50 may be real lines provided if desired on a table situated directly beneath the upper run of the conveyer 10. When the light line is located at the location $M_1$ shown for the length of timber $a_1$ in FIG. 2, this light line is situated at the aligning distance b from one of these lines 50 which is nearest to the defect V on one side thereof. Thus the angular position of the crank means 7 corresponds to the distance b, and the corresponding signal of a magnitude which corresponds to the distance b is transmitted to the structure which operates the pusher means 20 so that the latter assumes an angular position which will act on the end of the timber length nearest to the operator for longitudinally displacing the timber lengths so that the length of timber $a_1$ assumes the position shown for the length of timber $a_2$ when it reaches the location of the pusher means 20. In this way the pusher means 20 is automatically adjusted so as to align the light line or cutting line $M_1$ with a particular one of the second lines 50. Thus it will be seen that in the example of FIG. 2 the cutting line has been shifted to a location where it is situated at three incremental distances Δ from the particular one of these lines 52 which is in line with the line of cutting 41 provided by the cutting means 40.

As is shown schematically in FIG. 2, the incremental moving means 30 is capable of having its units 31 operated in such a way as to move each length of timber through a number of incremental distances Δ shown in FIG. 2 between the lines 54 which are situated on the other side of the line 52 from the lines 50 with these distances between the lines 54 being equal to the distances between the lines 50. The angular position of the crank means 7 is such that automatically through the above-described circuitry the unit G will transmit to the incremental moving means 30 a signal to move the length of timber through the required number of incremental distances which will situate the cutting line in alignment with the line 52 along which the cut will be made by the cutting means 40. Thus in the example shown in FIG. 2 the incremental moving means will act on the length of timber to move it through three of these incremental distances Δ so as to situate the cutting line precisely in alignment with the line 52. The length of timber $a_1$ thus is shown at the pusher means and is designated tubular length $a_2$. At this location, the cutting line has been properly aligned with one of the lines 50. The length of timber $a_1$ is also shown after having been moved by the incremental moving means 30 (designated timber length $a_3$) whereby the cutting line has been shifted into alignment with the line 52. When the length of timber has been moved by the incremental moving means 30 in a step-by-step manner through the required number of incremental distances, the unit 30 which acts on the length of timber releases the latter so that it continues to be conveyed by the conveyer means 10 across the cutting means 40 to be cut at the cutting line 41, thus dividing the length of timber into the tubular length portions $a_5$ and $a_6$ indicated in FIG. 2.

The various steps in the operation are indicated by the Roman numerals in FIG. 2. Thus at step I the operator $A_1$ positions the light line at the location $M_1$, as described above, and when the length of timber is in front of the operator at step I, the operator closes the switch $k_1$. Now the potentiometer unit $P_1$ actuated by the operator $A_1$ will transmit the required signals by way of the units $C_1$ and $D_1$ to the pair of means 20 and 30 in the manner described avove with the required delays being provided by the unit $D_1$.

At step II the length of timber indicated as $a_2$ has been precisely aligned so that its cutting line coincides with the line 50 shown in FIG. 2 designated by ($M_1$). At step III, in the case of FIG. 2, the length of timber $a_3$ has been moved to the position in the manner described above so that the cutting line is now in alignment with the line along which the cutting means 40 will cut the timber. At step IV the properly positioned timber length shown as $a_4$ is conveyed toward the cutting means while at step V the separation of the timber into a pair of portions has already taken place, and the pair of timber pieces are now acted upon by further conveyers to carry them to suitable locations.

It is to be understood that the above-described method and apparatus of the invention is only by way of example. The details referred to above may vary greatly within the concept of the present invention. Thus, the transmitting of the signals, for example, may be further developed by utilizing the angular position of the mirror 1 in order to directly transmit the required signals at the instant when a particular length of timber has reached the given location in front of the particular operator and the operator has correctly positioned the light line.

In addition, the system may be changed in such a way so as to first provide a signal only to the pusher means 20 and thereafter only to provide a signal to the step-by-step incremental moving means 30. The degree of automatic which will be used depends upon the capacity of the installation. From the standpoint of the particular installaton, it is not essential that only a single light line be used. Thus there may be several sequential light lines spaced from each other by sufficiently narrow spaces so that they may be fixedly arranged with a signal being transmitted according to a particular one of these light lines. From the point of view of the present invention, the use of light lines is not absolutely essential. The simplest form of the invention need only utilize lines painted or otherwise provided on a table beneath the moving length of timber and indicating the required distances through which the lengths of timber must be moved for proper situation of the cutting lines. It is of course also possible to provide a mark directly on a length of timber, in which case the most practical way to carry out the first movement at least is to utilize an optical stopping impulse controlled by such a mark. Of course, the movement of the length of timber can be carried out in either one of a pair of opposed directions extending longitudinally of the length of timber and applied thereto at both ends thereof.

Thus, the invention is not to be restricted to the above-described details which are only given by way of example. These details may vary within the framework of the inventive concept as defined by the claims which follow.

What is claimed is:

1. In a method for removing, from lengths of timber, pieces thereof which have defects therein, the steps of continuously conveying the lengths of timber along a predetermined path with the lengths of timber arranged in succession along said path extending transversely thereof, determining an aligning distance for a given one of said lengths of timber which has a defect therein, as said given length of timber approaches a given location along said path, said aligning distance being defined by the distance between a cutting line extending across said given length of timber next to said defect and one of a series of second lines nearest to said cutting line on one side thereof and all extending parallel to each other in the direction of said path and situated at predetermined equal incremental distances from each other, transmitting to an adjustable pusher when said given length of timber reaches said given location, a first signal at a selected magnitude corresponding to said aligning distance, said adjustable pusher being situated in the path of movement of an end of said given length of timber at a second location located along said path subsequent to said given location for adjusting said pusher to push said given length of timber transversely of said path through said aligning distance, so that upon reaching said second location said given length of timber will be shifted transversely of said path to align said cutting line with said one of said second lines, and also transmitting a second signal to an incremental moving means situated at a third location along said path subsequent to said second location for actuating said incremental moving means in response to said second signal to move said given length of timber when it reaches said third location through a given number of incremental distances transversely of said path equal to the incremental distances between said second lines and sufficient to situate said cutting line in alignment with a predetermined one of said second lines with which a cutting means is aligned at a fourth location along said path subsequent to said third location, cutting said given length at said fourth location with said cutting means to separate the given length of timber into a pair of pieces only one of which will have said defect.

2. In a method as recited in claim 1 and including the steps of simultaneously transmitting said first and second signals respectively to said adjustable pusher and incremental moving means respectively with delays of different magnitudes sufficient to provide for pushing of said given length of timber with said pusher when said given length of timber reaches said second location and moving of said given length of timber by said incremental moving means when said given length of timber reaches said third location.

3. In a method as recited in claim 1 and including the steps of transmitting said first and second signals to said pusher and incremental moving means, respectively, from a plurality of said given locations for different given lengths of timber which respectively reach said plurality of given locations.

4. In a method as recited in claim 1 and including the step of situating a line of light next to said defect for providing said cutting line and for determining said aligning distance.

5. In an apparatus for removing, from lengths of timber, pieces thereof which have defects therein, conveyer means for conveying lengths of timber continuously along a predetermined path with the lengths of timber arranged in succession along said path extending transversely thereof, indicator means situated at a given location along said path for determining for a given one of said lengths of timber having a defect therein an aligning distance between a cutting line extending across said lengths of timber next to said defect and one of a series of second lines nearest to said cutting line on one side thereof and all extending parallel to each other in the direction of said path and situated at predetermined equal incremental distances from each other, adjustable pusher means situated at a second location along said path subsequent to said given location in the path of movement of ends of said lengths of timber for pushing the latter transversely of said path through distances determined by the adjustment of said adjustable pusher means, incremental moving means situated at a third location along said predetermined path subsequent to said second location for engaging the lengths of timber which reach said third location and incrementally moving the same transversely of said path through a predetermined number of incremental distances each of which is of a given length, cutting means situated at a fourth location along said predetermined path subsequent to said third location in alignment with one of said series of second lines for cutting across the lengths of timber which reach said fourth location, and signal-transmitting means operatively connected between said indicating means and said adjustable pusher means and incremental moving means for transmitting to said adjustable pusher means a signal the magnitude of which corresponds to said aligning distance for adjusting said adjustable pusher means to align a given length of timber which has a defect therein at said cutting line with said second line which is nearest to said cutting line on one side thereof and for transmitting a signal to said incremental moving means for actuating the latter to move a length of timber which has been acted upon by said pusher means through a number of incremental distances sufficient to locate said cutting line in alignment with that one of said second lines with which said cutting means is aligned, so that upon conveying of a length of timber beyond said incremental moving means the length of timber will be cut along said cutting line by said cutting means.

6. The combination of claim 5 and wherein said indicating means includes a light source for providing a line of light, adjustable reflecting means receiving the line of light from said light source and reflecting the latter toward the pieces of timber conveyed by said conveyer means for providing on the pieces of timber a line of light extending transversely across the pieces of timber in the direction of said predetermined path to indicate the cutting line on the pieces of timber, manually operable crank means operatively connected with said adjustable reflecting means for adjusting the latter to situate the line of light next to a defect for indicating said cutting line when a given length of timber reaches said given location, and said signal-transmitting means being operatively connected with said manually operable crank means to be operated thereby.

7. The combination of claim 6 and wherein said signal-transmitting means includes a pair of potentiometers respectively having sliders engaging the same and connected with said crank means to be moved thereby for providing from said pair of potentiometers said first and second signals.

8. In an apparatus for removing from lengths of timber, while they are conveyed along a predetermined path, pieces thereof which have defects therein: light-source means for providing a line of light, adjustable reflecting means situated in the path of the line of light from said light-source means for reflecting said line of light onto the lengths of timber while they are conveyed along said predetermined path, manually operable means operatively connected with said adjustable reflecting means for adjusting the latter to situate a line of light on a given length of timber next to a defect therein, and signal-transmitting means operatively connected to said manually operable means to be operated thereby for transmitting signals in accordance with the operation of said manually operable means to devices which act on the timber lengths to provide for cutting thereof at the location of a line of light next to a defect in a length of timber.

9. The combination of claim 8 and wherein said manually operable means includes a manually turnable crank means, said signal-transmitting means including at least one potentiometer having a slider operatively connected with said crank means to be moved thereby along said potentiometer for determining the magnitude of at least one signal.

10. The combination of claim 8 and wherein a pair of potentiometers are situated beside each other and respectively have slider means operatively connected with said crank means to be simultaneously moved thereby along said pair of potentiometers for providing from the latter two signals to be utilized in properly situating a length of timber to be cut along the line determined by the location of the line of light next to a defect in a length of timber.

* * * * *